US012674219B2

(12) United States Patent
Kim

(10) Patent No.: US 12,674,219 B2
(45) Date of Patent: Jul. 7, 2026

(54) STEEL MATERIAL HAVING EXCELLENT HYDROGEN INDUCED CRACKING RESISTANCE, AND MANUFACTURING METHOD THEREFOR

(71) Applicant: POSCO, Pohang-si (KR)

(72) Inventor: Dae-Woo Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 1023 days.

(21) Appl. No.: 17/297,834

(22) PCT Filed: Nov. 19, 2019

(86) PCT No.: PCT/KR2019/015845
§ 371 (c)(1),
(2) Date: May 27, 2021

(87) PCT Pub. No.: WO2020/111628
PCT Pub. Date: Jun. 4, 2020

(65) Prior Publication Data

US 2022/0010403 A1 Jan. 13, 2022

(30) Foreign Application Priority Data

Nov. 29, 2018 (KR) ..... 10-2018-0150704

(51) Int. Cl.

| | |
|---|---|
| ***C21D 9/46*** | (2006.01) |
| ***C21D 1/28*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.
CPC ..... *C21D 9/46* (2013.01); *C21D 1/28* (2013.01); *C21D 6/004* (2013.01); *C21D 6/005* (2013.01); *C21D 6/008* (2013.01); *C21D 8/02* (2013.01); *C21D 8/0226* (2013.01); *C21D 8/0263* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C21D 2211/005* (2013.01); *C21D 2211/009* (2013.01)

(58) Field of Classification Search
CPC ..... C21D 9/46
See application file for complete search history.

(56) References Cited

U.S. PATENT DOCUMENTS

| | | | | |
|---|---|---|---|---|
| 11,634,785 | B2 * | 4/2023 | Kim | C22C 38/04 148/653 |
| 2019/0024206 | A1 | 1/2019 | Kim | |
| 2021/0062285 | A1 * | 3/2021 | Kim | C22C 38/42 |

FOREIGN PATENT DOCUMENTS

| | | | | |
|---|---|---|---|---|
| EP | 3561124 | A1 | 10/2019 | |
| JP | H08-283839 | A | 10/1996 | |
| JP | 2003-013175 | A | 1/2003 | |
| JP | 2014-005534 | A | 1/2014 | |
| JP | 2017-048443 | A | 3/2017 | |
| KR | 10-2008-0036475 | A | 4/2008 | |
| KR | 10-0833071 | B1 | 5/2008 | |
| KR | 10-0951249 | B1 | 4/2010 | |
| KR | 10-2010-0076727 | A | 7/2010 | |
| KR | 10-2011-0060449 | A | 6/2011 | |
| KR | 10-2012-0074638 | A | 7/2012 | |
| KR | 10-2013-0002175 | A | 1/2013 | |
| KR | 101253890 | B1 * | 4/2013 | C21D 1/28 |
| KR | 10-2015-0124810 | A | 11/2015 | |
| KR | 10-1736638 | B1 | 5/2017 | |
| KR | 10-2019-0077830 | A | 7/2019 | |
| WO | 2018/117545 | A1 | 6/2018 | |

OTHER PUBLICATIONS

International Search Report dated Mar. 3, 2020 issued in International Patent Application No. PCT/KR2019/015845 (with English translation).
Japanese Office Action dated Aug. 2, 2022 issued in Japanese Patent Application No. 2021-530860.
Extended European Search Report dated Sep. 6, 2021 issued in European Patent Application No. 19891660.3.

* cited by examiner

*Primary Examiner* — Christopher S Kessler
(74) *Attorney, Agent, or Firm* — Morgan Lewis & Bockius LLP

(57) ABSTRACT

The present invention relates to a steel material for a pressure vessel, which is used in a hydrogen sulfide atmosphere, and, more specifically, to a steel material having excellent hydrogen induced cracking (HIC) resistance, and a manufacturing method therefor.

6 Claims, No Drawings

STEEL MATERIAL HAVING EXCELLENT HYDROGEN INDUCED CRACKING RESISTANCE, AND MANUFACTURING METHOD THEREFOR

CROSS-REFERENCE OF RELATED APPLICATIONS

This application is the U.S. National Phase under 35 U.S.C. § 371 of International Patent Application No. PCT/KR2019/015845, filed on Nov. 19, 2019, which in turn claims the benefit of Korean Application No. 10-2018-0150704, filed on Nov. 29, 2018, the entire disclosures of which applications are incorporated by reference herein.

TECHNICAL FIELD

The present disclosure relates to a steel material for a pressure vessel used in a hydrogen sulfide atmosphere, and, more particularly, to a steel material having excellent hydrogen induced cracking (HIC) resistance, and a manufacturing method therefor.

BACKGROUND ART

Recently, in accordance with an increase in a use time of a steel material fora pressure vessel used in petrochemical manufacturing facilities, storage tanks and the like, enlargement of a facility and an increase in a thickness of the steel material have been undertaken. In addition, in manufacturing a large structure, there is a tendency to lower a carbon equivalent (Ceq) and to extremely control impurities in order to secure structural stability of a weld zone, together with a base material. In addition, in accordance with an increase in the production of crude oil containing a large amount of $H_2S$, quality characteristics such as resistance to hydrogen induced cracking (HIC) have become more difficult.

In particular, steel materials used for all plant facilities for mining, processing, transporting, and storing low-quality crude oil have necessarily been required to have a property of suppressing the occurrence of cracks caused by wet hydrogen sulfide in the crude oil. Recently, environmental pollution caused by accidents in plant facilities has become a global problem, and as a significant cost is required for solving such environment pollution, a level of HIC resistance required for a steel material used in an energy industry has gradually become more stringent.

Meanwhile, an occurrence principle of hydrogen induced cracking (HIC) of the steel material is as follows. A surface of the steel material comes into contact with the wet hydrogen sulfide contained in the crude oil, such that corrosion of the steel material occurs, and hydrogen atoms generated by the corrosion of the steel material permeate and diffuse into the steel material to exist in an atomic state in the steel material. The hydrogen atoms permeating and diffusing into the steel material are molecularized in a form of a hydrogen gas to generate a gas pressure, and brittle cracks are caused in weak structures (for example, inclusions, segregation regions, internal voids, and the like) in the steel material due to such a gas pressure. The cracks gradually grow due to the lapse of a use time and continuous application of a load to finally cause destruction of the steel material.

Therefore, various technologies for a method of improving hydrogen induced cracking (HIC) resistance of a steel material used in a hydrogen sulfide atmosphere have been developed.

Examples of such technologies include a method of adding an element such as copper (Cu), a method of minimizing a hardened structure (for example, a pearlite phase, or the like) in which a crack easily occurs and propagates or controlling a shape of the hardened structure, a method of controlling internal defects such as inclusions and voids in a steel that may act as an initiation point of integration of hydrogen and a crack, a technology of increasing resistance to crack initiation by changing a processing process to form a matrix structure as a hard structure such as tempered martensite or tempered bainite through water treatment such as normalizing and accelerated cooling and tempering (NACT), quenching and tempering (QT), and direct quenching and tempering (DQT), and the like.

The method of adding copper (Cu) or the like may have an effect of suppressing penetration of hydrogen into the steel material by forming a stable CuS coating on a surface of the steel material in a weakly acidic atmosphere, thereby obtaining an effect of improving hydrogen induced cracking (HIC) resistance.

However, it has been known that the effect of the addition of Cu described above is not great in a strongly acidic atmosphere, and high-temperature cracking occurs due to the added Cu, such that a crack may be caused in a surface of a steel sheet. Therefore, a process such as surface polishing is required, and a process cost is thus increased.

Among the technologies described above, the method of minimizing the hardened structure or controlling the shape of the hardened structure is a method of delaying a crack propagation speed by lowering a band index (B.I.) value of a band structure generated in a matrix phase after normalizing heat treatment.

In this regard, Patent Document 1 discloses that a ferrite+pearlite structure having a B.I. (measured according to American Society for Testing Materials (ASTM) E-1268) of 0.25 or less is obtained by controlling an alloy composition and a manufacturing condition and a steel having a tensile strength of about 500 MPa and excellent HIC resistance (NACE standard average CLR: 0) may be provided.

However, since the method of minimizing the hardened structure as described above mainly improves resistance to propagation of a crack due to HIC, there is a risk that an effect of improving the resistance to the propagation of the crack will be decreased when coarse voids or the like exist in the steel material.

Meanwhile, the method of using water treatment such as the NACT, the QT, the DQT, and thermo mechanical control process (TMCP) rather than the normalizing heat treatment as the processing process may increase a strength of the matrix phase by forming the matrix phase with tempered martensite, tempered bainite, or a composite structure thereof rather than ferrite+pearlite. When the strength of the matrix phase is increased, resistance to crack initiation is increased, and a frequency of occurrence of the crack may be relatively decreased.

In this regard, Patent Document 2 discloses that HIC resistance may be improved by controlling an alloy composition and performing accelerated cooling after hot rolling, and Patent Document 3 discloses that HIC resistance may be improved by securing a tempered martensite structure through a DQT process.

However, when a matrix phase is formed of a low-temperature structure (for example, martensite, bainite, acicular ferrite, or the like), HIC resistance is improved, while hot forming becomes impossible, such that it may be difficult to form a pipe for a pressure vessel, a surface hardness value is high, such that uniform elongation of a product is decreased, and a surface crack occurrence rate may be increased in a processing process. In addition, in a case of an extremely thick steel material having a thickness exceeding 100 mm, coolingability of a central portion of a product at the time of quenching is significantly decreased, and it is thus difficult to secure a sufficiently low-temperature transformation structure, and there is a risk that HIC resistance will be deteriorated due to generation of a martensite-austenite constituent (MA) phase that may act as an initiation point of HIC cracking.

Further, as a method of improving HIC resistance by minimizing inclusions or voids in a slab to increase cleanliness, Patent Document 4 discloses a steel material having excellent HIT resistance by adding Ca into a molten steel and a content of Ca is controlled according to a specific equation: $0.1 \leq (T.[Ca]-(17/18)\times T.[0]-1.25\times S)/T[O] \leq 0.5$ . . . (1) (here, T.[Ca] is a total concentration (ppm) of Ca in a steel, T.[O] is a total concentration (ppm) of oxygen in a steel, and S is an S concentration (ppm) in a steel). Such a method may help to improve an HIC quality by reducing an amount of oxidizing inclusions crushed in a rolling process of a thin sheet steel with a high cumulative rolling reduction.

However, as a thickness of the steel material increases, HIC resistance is deteriorated due to a central void defect rather than a defect due to oxidizing inclusions, and the residual voids existing in a central portion of the steel material may not be sufficiently mechanically bonded by only a rolling process, and thus, there is a limitation in improving HIC resistance.

As described above, the technologies described above have a limitation in being applied to thick steel materials having a large thickness, and have a limitation in manufacturing a steel material for a pressure vessel because it is difficult to secure sufficient hydrogen induced cracking (HIC) resistance characteristics when they are applied particularly to a steel material having a thickness of 50 to 300 mm and a tensile strength of 500 MPa.

(Patent Document 1) Korean Patent Laid-Open Publication No. 2010-0076727

(Patent Document 2) Japanese Patent Laid-Open Publication No. 2003-013175

(Patent Document 3) Korea Patent No. 10-0833071

(Patent Document 4) Japanese Patent Laid-Open Publication No. 2014-005534

DISCLOSURE

Technical Problem

An aspect of the present disclosure is to provide a steel material having excellent resistance to hydrogen induced cracking (HIC) in a hydrogen sulfide atmosphere and a manufacturing method therefor.

An object of the present disclosure is not limited to the abovementioned contents. Those skilled in the art will have no difficulty in understanding an additional object of the present disclosure from the general contents of the present specification.

Technical Solution

According to an aspect of the present disclosure, a steel material having excellent hydrogen induced cracking resistance contains: by wt %, 0.10 to 0.25% of carbon (C), 0.05 to 0.50% of silicon (Si), 1.0 to 2.0% of manganese (Mn), 0.005 to 0.1% of aluminum (Al), 0.010% or less of phosphorus (P), 0.0015% or less of sulfur (S), 0.001 to 0.03% of niobium (Nb), 0.001 to 0.03% of vanadium (V), 0.001 to 0.03% of titanium (Ti), 0.01 to 0.20% of chromium (Cr), 0.01 to 0.15% of molybdenum (Mo), 0.01 to 0.50% of copper (Cu), 0.05 to 0.50% of nickel (Ni), 0.0005 to 0.0040% of calcium (Ca), a balance of Fe, and other inevitable impurities, wherein a length ratio of a short side portion to a long side portion (short side portion/long side portion) of a void formed at a central portion of the steel material is 0.7 or more.

According to another aspect of the present disclosure, a manufacturing method for a steel material having excellent hydrogen induced cracking resistance includes: reheating a steel slab in a temperature range of 1150 to 1250° C., the steel slab having the alloy composition described above; finish hot rolling the reheated steel slab in a temperature range of 800 to 1100° C. to manufacture a hot-rolled steel sheet; cooling the hot-rolled steel sheet to a temperature directly above Bs at a cooling rate of 3 to 60° C./s; and performing normalizing heat treatment for heating the hot-rolled steel sheet to 860 to 930° C. after the cooling, maintaining the hot-rolled steel sheet for 15 to 60 minutes, and then air-cooling the hot-rolled steel sheet to room temperature, wherein a reduction ratio per pass at the time of finish hot rolling the reheated steel slab is 5% or less.

Advantageous Effects

As set forth above, according to an exemplary embodiment in the present disclosure, a steel material having a thickness of 50 to 200 mm suitable for a pressure vessel and having effectively secured hydrogen induced cracking (HIC) resistance may be provided.

BEST MODE FOR INVENTION

The inventor of the present disclosure has studied in depth to obtain a steel material that may be suitably used for purposes such as purification, transportation, and storage of crude oil or the like due to excellent resistance to hydrogen induced cracking thereof in providing a thick steel material having a predetermined thickness.

In particular, the present disclosure has confirmed that in order to improve hydrogen induced cracking resistance of a steel material having a thickness of 50 to 200 mm, it is necessary to control not only a structural configuration of the steel material but also a shape of a void at a central portion of the steel material, and has a technical significance in presenting a suitable alloy composition, manufacturing condition and the like.

Hereinafter, the present disclosure will be described in detail.

A steel material having excellent hydrogen induced cracking resistance according to an exemplary embodiment in the present disclosure may contain, by wt %, 0.10 to 0.25% of carbon (C), 0.05 to 0.50% of silicon (Si), 1.0 to 2.0% of manganese (Mn), 0.005 to 0.1% of aluminum (Al), 0.010% or less of phosphorus (P), 0.0015% or less of sulfur (S), 0.001 to 0.03% of niobium (Nb), 0.001 to 0.03% of vanadium (V), 0.001 to 0.03% of titanium (Ti), 0.01 to 0.20% of chromium (Cr), 0.01 to 0.15% of molybdenum (Mo), 0.01 to 0.50% of copper (Cu), 0.05 to 0.50% of nickel (Ni), and 0.0005 to 0.0040% of calcium (Ca).

Hereinafter, the reason for limiting an alloy composition of the steel material provided by the present disclosure as described above will be described in detail. In this case, unless otherwise specified, a content of each element refers to a weight content.

Carbon (C): 0.10 to 0.25%

Carbon (C) is the most important element in securing a strength of a steel, and thus, needs to be contained in the steel in an appropriate range. In order to obtain an effect of adding C, a content of C is preferably 0.10% or more, but when the content of C exceeds 0.25%, there is a risk that a segregation degree in a central portion of the steel material will increase and a strength or a hardness will be excessive due to formation of a ferrite+bainite structure in a air cooling process. In addition, there is a problem that an MA structure is generated, such that HIC resistance is deteriorated.

Therefore, in the present disclosure, the content of C may be 0.10 to 0.25%, more advantageously 0.10 to 0.20%, and even more advantageously 0.10 to 0.15%.

Silicon (Si): 0.05 to 0.5%

Silicon (Si) is a substitutional element, and is an element that improves a strength of the steel material through solid solution strengthening and has a strong deoxidation effect, and is thus essential in manufacturing a clean steel. In order to obtain the effect described above, a content of added Si is preferably 0.05% or more. However, when the content of Si is excessive, an MA phase is generated and a ferrite matrix strength is excessively increased, such that deterioration of HIC resistance, impact toughness and the like may be caused. Therefore, an upper limit of the content of Si may be limited to 0.5% in consideration of such a situation.

Therefore, in the present disclosure, the content of Si may be 0.05 to 0.5%, more advantageously 0.05 to 0.40%, and even more advantageously 0.20 to 0.35%.

Manganese (Mn): 1.0 to 2.0%

Manganese (Mn) is an element that is useful for improving a strength by solid solution strengthening and improving hardenability so that a low-temperature transformation phase is generated. In addition, Mn is a main element for securing a low-temperature bainite phase at the time of air-cooling after normalizing heat treatment because it may generate a low-temperature transformation phase even at a slow cooling rate due to improvement of hardenability. In order to sufficiently obtain the effect described above, a content of Mn is preferably 1.0% or more. However, when the content of Mn exceeds 2.0%, central segregation is increased to form MnS inclusions with sulfur (S) in the steel, and a fraction thereof is increased, such that HIC resistance may be deteriorated.

Therefore, in the present disclosure, the content of Mn may be 1.0 to 2.0%, more advantageously 1.0 to 1.7%, and even more advantageously 1.0 to 1.5%.

Aluminum (Al): 0.005 to 0.1%

Aluminum (Al) is an element that acts as a strong deoxidizer in a steelmaking process, along with Si. In order to obtain such an effect, a content of added Al is preferably 0.005% or more. However, when the content of Al exceeds 0.1%, there is a problem that a fraction of $Al_2O_3$ among oxidizing inclusions generated as a result of deoxidation is excessively increased and a size of $Al_2O_3$ becomes coarse, such that it becomes difficult to remove $Al_2O_3$ in a refining process. For this reason, there is a risk that HIC resistance will be deteriorated due to oxidizing inclusions remaining in a final product.

Therefore, in the present disclosure, the content of Al may be 0.005 to 0.1%, more preferably 0.01 to 0.05%, and even more preferably 0.01 to 0.035%.

Phosphorus (P): 0.010% or less

Phosphorus (P) is an element that is inevitably contained in the steelmaking process, and is an element that causes brittleness at grain boundaries. In the present disclosure, in order to improve brittle crack arrestability of the steel material, a content of P may be limited to 0.010% or less, and 0% may be excluded in consideration of the fact that P is inevitably contained.

Sulfur (S): 0.0015% or less

Sulfur (S) is also an element that is inevitably contained in the steelmaking process, and is an element that causes brittleness by forming coarse inclusions. In the present disclosure, in order to improve brittle crack arrestability, a content of S may be limited to 0.0015% or less, and 0% may be excluded in consideration of the fact that S is inevitably contained.

Niobium (Nb): 0.001 to 0.03%

Niobium (Nb) is an element that is precipitated in a form of NbC or NbCN to be useful for improving a strength of a base metal. In addition, Nb solid-dissolved at the time of reheating to a high temperature is very finely precipitated in a form of NbC in a subsequent rolling process to suppress recrystallization of austenite, thereby making a structure fine. In order to sufficiently obtain the effect described above, a content of Nb may be 0.001% or more. However, when the content of Nb is excessive, undissolved Nb is generated in a form of TiNb (C,N) to cause a UT defect, deterioration of impact toughness and hinder HIC resistance, and an upper limit of the content of Nb may thus be limited to 0.03%.

Therefore, in the present disclosure, the content of Nb may be 0.001 to 0.03%, and more advantageously 0.007 to 0.015%.

Vanadium (V): 0.001 to 0.03%

Vanadium (V) is almost all re-solid-dissolved at the time of reheating, and is thus an element of which a strength strengthening effect by precipitation or solid solution in a subsequent rolling process or the like is insufficient, but is precipitated as a very fine carbonitride in a subsequent heat treatment process (for example, post weld heat treatment (PWHT), etc.) to have an effect of improving a strength. In addition, vanadium has an effect of increasing a fraction of air-cooled bainite by increasing hardenability of austenite after normalizing heat treatment. In order to obtain the effect described above, a content of V is preferable 0.001% or more, but when the content of V exceeds 0.03%, a strength and a hardness of a weld zone may be excessively increased, which may act as a factor of a surface crack or the like at the time of processing a pressure vessel.

Therefore, in the present disclosure, the content of V may be 0.001 to 0.03%, more advantageously 0.005 to 0.02%, and even more advantageously 0.007 to 0.015%.

Titanium (Ti): 0.001 to 0.03%

Titanium (Ti) is an element that is precipitated as TiN at the time of reheating to suppress crystal grain growth of not only a base material but also a heat affected zone formed at the time of welding, thereby significantly improves low-temperature toughness. In order to sufficiently obtain such an effect, a content of Ti is preferably 0.001% or more. However, when the content of Ti exceeds 0.03%, there is a risk that the low-temperature toughness will be deteriorated due to clogging of a continuous casting nozzle or crystallization of a central portion. In addition, when a coarse TiN precipitate is formed at a central portion of a thickness by bond of Ti to N in the steel, there is a risk that it will act as an initiation point of hydrogen induced cracking.

Therefore, in the present disclosure, the content of Ti may be 0.001 to 0.03%, more preferably 0.011 to 0.025%, and even more preferably 0.013 to 0.018%.

Chromium (Cr): 0.01 to 0.20%

Chromium (Cr) is an element of which an effect of increasing a yield strength and a tensile strength by solid solution is insufficient, but which effectively prevents a decrease in a strength by reducing a decomposition rate of cementite during a subsequent tempering process or post weld heat treatment (PWHT). In order to sufficiently obtain the effect described above, a content of Cr is preferably 0.01% or more. However, when the content of Cr exceeds 0.20%, a size and a fraction of Cr-Rich carbide such as $M_{23}C_6$ may be increased to significantly impair impact toughness.

Therefore, in the present disclosure, the content of Cr may be 0.01 to 0.20%.

Molybdenum (Mo): 0.01 to 0.15%

Molybdenum (Mo) is an element that is effective in preventing a decrease in a strength during tempering or post weld heat treatment (PWHT) like Cr, and is an element that effectively prevents deterioration of toughness caused by segregation of impurities such as P at a grain boundary. In addition, Mo is a solid solution strengthening element in ferrite, and has an effect of increasing a strength of a matrix. In order to obtain the effect described above, a content of added Mo is preferably 0.01% or more. However, when Mo, which is an expensive element, is excessively added, a manufacturing cost significantly increases, and an upper limit of the content of Mo may thus be limited to 0.15%.

Therefore, in the present disclosure, the content of Mo may be 0.01 to 0.15%.

Copper (Cu): 0.01 to 0.50%

Copper (Cu) is an element that may greatly improve a strength of a matrix phase by solid solution strengthening in ferrite, and is an element that effectively suppresses corrosion of a base material in a wet hydrogen sulfide atmosphere. In order to obtain the effect described above, a content of Cu is preferably 0.01% or more. However, when the content of Cu exceeds 0.50%, a possibility that a star crack will be caused in a surface of the steel material increases, and there is a problem that a manufacturing cost is increased due to Cu, which is an expensive element.

Therefore, in the present disclosure, the content of Cu may be 0.01 to 0.50%.

Nickel (Ni): 0.05 to 0.50%

Nickel (Ni) is a main element that increase a stacking defect at a low temperature to allow a cross slip of dislocation to easily reveal, and thus improve impact toughness and hardenability, thereby improving a strength. In order to obtain the effect described above, a content of Ni is preferably 0.05% or more. However, when the content of Ni is excessive to exceed 0.50%, there is a risk that the hardenability will be excessively increased, and there is a problem that a manufacturing cost is increased due to Ni, which is an expensive element.

Therefore, in the present disclosure, the content of Ni may be 0.05 to 0.50%, more preferably 0.10 to 0.40%, and even more preferably 0.10 to 0.30%.

Calcium (Ca): 0.0005 to 0.0040%

When calcium (Ca) is added after deoxidation by aluminum (Al), it may be bonded to S forming MnS inclusions to suppress generation of MnS, and at the same time, form spherical CaS to suppress occurrence of a crack due to hydrogen induced cracking. In order to obtain the effect described above, a content of added Ca is preferably 0.0005% or more, but when the content of Ca exceeds 0.0040%, CaS is formed and the remaining Ca is bonded to O to form coarse oxidizing inclusions, which are elongated and destroyed at the time of rolling to promote hydrogen induced cracking.

Therefore, in the present disclosure, the content of Ca may be 0.0005 to 0.0040%.

In the present disclosure, in addition to the steel compositions described above, the remainder may be Fe and inevitable impurities. The inevitable impurities may be unintentionally mixed in a general steelmaking process and may not be completely excluded, and those skilled in a general steelmaking field may easily understand the meaning of the inevitable impurities. In addition, the present disclosure does not entirely exclude addition of a composition other than the steel compositions described above.

In the steel material according to the present disclosure having the alloy composition described above, a length ratio of a short side portion to a long side portion (short side portion/long side portion) of a void formed at a central portion of the steel material is preferably 0.7 or more.

Since the void formed inside the steel material may act as an initiation point of cracking, a shape of the void needs to be appropriately managed in order to secure hydrogen induced cracking resistance of the steel material. In particular, in a case of a thick steel material having a thickness of 50 to 200 mm, such as the steel material of the present disclosure, a size and a shape of a void existing inside the thick steel material greatly affects whether hydrogen induced cracking occurs. Therefore, the present disclosure intends to secure hydrogen induced cracking resistance by limiting a shape of a void formed at a central portion of the steel material. Specifically, in the present disclosure, the shape of the void formed at the central portion of the steel material is to be as spherical as possible, and the length ratio of the short side portion to the long side portion of the void may be preferably 0.7 or more.

Here, the central portion of the steel material may be a region of ¼t to ½t (here, t refers to a thickness (mm) of the steel material) in a thickness direction from a surface of the steel material.

In addition, the steel material according to the present disclosure may contain a composite structure of ferrite having an area fraction of 70% or more and the balance pearlite as a microstructure.

Specifically, a steel material provided through the normalizing heat treatment may have a mixed structure of a ferrite structure and a pearlite structure, and the steel material having these structures may have a strength determined by a fraction of the pearlite structure. In this case, when the pearlite structure exceeds 30% of an area fraction, the strength of the steel increases, but impact toughness is deteriorated. Thus, in the present disclosure, in order to secure a tensile strength of 500 MPa or more and a Charpy impact absorption energy of 230 J or more at −50° C., an area ratio of the ferrite structure may be limited to 70% or more.

A fraction of the pearlite structure may be predicted according to the content of carbon contained in the steel.

In addition, in the steel material according to the present disclosure, an average crystal grain size of the ferrite is preferable 40 μm or less. When the average crystal grain size of the ferrite exceeds 40 μm, a strength and toughness of a target level may not be secured. In order to obtain intended physical properties more advantageously, the average crystal grain size of the ferrite is more preferably 30 μm or less, and even more preferably 20 μm or less.

Here, the average crystal grain size refers to an average diameter equivalent to a circle, which may be understood by those skilled in the art.

Therefore, the steel material having excellent hydrogen induced cracking resistance in the present disclosure is a thick steel material having a thickness of 50 to 200 mm, and may have a tensile strength of 500 MPa or more, a Charpy impact absorption energy at −50° C. of 230 J or more, and a hydrogen induced cracking crack length ratio (CLR) of 5% or less. Therefore, the steel material having excellent hydrogen induced cracking resistance according to the present disclosure may secure a thickness and physical properties suitable for a pressure vessel.

A manufacturing method for a steel material having excellent hydrogen induced cracking resistance according to another exemplary embodiment in the present disclosure will hereinafter be described in detail.

The steel material having excellent hydrogen induced cracking resistance according to an exemplary embodiment in the present disclosure may be manufactured by preparing a slab having the alloy composition described above, and then performing processes of [reheating-hot rolling-cooling-normalizing heat treatment].

An alloy composition and its content of the slab according to the present disclosure correspond to the alloy composition and its content of the steel material described above, and a description for the alloy composition and its content of the slab according to the present disclosure is thus replaced by the description of the alloy composition and its content of the steel material described above.

Steel Slab Reheating

First, a steel slab may be reheated in a temperature range of 1150 to 1250° C.

In order to prevent a temperature from being significantly lowered when the steel slab is manufactured and extracted and is reduced in a subsequent rolling process, the steel slab may be heated at 1150° C. or higher. However, when a heating temperature exceeds 1250° C., oxidized scale is excessively generated on a surface of the steel slab, and cost competitiveness in furnace operation is lowered. Therefore, in the present disclosure, a steel slab heating temperature may be limited to 1250° C. or lower.

Finish Hot Rolling

The steel slab reheated as described above may be hot-rolled to manufacture a hot-rolled steel sheet. In this case, finish hot rolling may be performed in a temperature range of 800 to 1100° C.

When the temperature at the time of the finish hot rolling is less than 800° C., there is a problem that a deformation resistance value of the slab is excessively high, such that rolling may be not performed at a target thickness. On the other hand, when the temperature at the time of the finish hot rolling exceeds 1100° C., there is a risk that sizes of crystal grains will become excessively coarse, such that toughness of the steel material will be deteriorated.

In the present disclosure, a reduction ratio per pass at the time of the finish hot rolling in the temperature range described above is preferably 5% or less (excluding 0%). The residual void exists at a central portion of the reheated steel slab, and in order to control a shape of such a void to be as spherical as possible, in the present disclosure, the reduction ratio per pass at the time of the finish hot rolling may be limited to 5% or less (excluding 0%). When the reduction ratio per pass at the time of the finish hot rolling exceeds 5%, compression is excessively performed, such that a ratio of a short side portion to a long side portion of the residual void may not be 0.7 or more. In this case, hydrogen induced cracking resistance of a final product may not be secured due to a notch effect at a cusp portion of the void.

By appropriately controlling the rolling temperature and the reduction ratio per pass at the time of the finish hot rolling as described above, an effect of offsetting the notch effect of the cusp portion of the void, which may be a starting point of hydrogen induced cracking may be obtained, and resultantly, hydrogen induced cracking resistance may be improved.

In addition, a length ratio of a short side portion to a long side portion (short side portion/long side portion) of the void formed at a central portion of the hot-rolled steel sheet after the finish hot rolling may be 0.7 or more, and a maximum size of the void is 10 μm or less, preferably 5 μm, and even more preferably 3 μm or less.

Cooling

The hot-rolled steel sheet manufactured through the finish hot rolling described above may be cooled. In this case, the hot-rolled steel sheet may be cooled to a temperature directly above Bs at a cooling rate of 3 to 60° C./s.

Since a normalizing heat-treated or quenching & tempered (Q&T) heat-treated steel material is subjected to a temperature re-rising process for heat treatment after rolling has ended, it is general to air-cool the steel material after the rolling, but in the present invention, it is preferable to perform cooling on the manufactured hot-rolled steel sheet at a constant cooling rate in consideration of coarsening of austenite crystal grains according to weak reduction performed in order to control the shape of the void formed at the central portion of the slab.

Specifically, in the present disclosure, accelerated cooling may be performed on the manufactured hot-rolled steel sheet to a temperature directly above Bs at a cooling rate of 3 to 60° C./s on the basis of ¼t (here, t indicates a thickness (mm)) of the manufactured hot-rolled steel sheet.

Since ferrite generated after the end of the rolling by the accelerated cooling described above generates nucleation in a low temperature region, very fine crystal grains as compared with ferrite crystal grains generated at the time of air cooling after existing rolling may be secured. In addition, there is an advantage that fine ferrite crystal grains may be secured even after subsequent normalizing heat treatment.

When the cooling rate at the time of cooling the hot-rolled steel sheet is less than 3° C./s, a low-temperature transformation ferrite phase is not sufficiently formed, whereas when the cooling rate at the time of cooling the hot-rolled steel sheet exceeds 60° C./s, a martensite phase is generated before the subsequent normalizing heat treatment. In a case of a non-diffusion transformation structure, a size of an austenite crystal grain is not decreased in a reheating process, and it becomes thus difficult to finely control a ferrite size after the normalizing heat treatment. In this case, a ductile-brittle transition temperature (DBTT) is increased, such that an impact toughness becomes inferior.

At the time of cooling the hot-rolled steel sheet at the cooling rate described above, a cooling end temperature is limited to a temperature directly above Bs (bainite transformation start temperature), such that a low-temperature transformation ferrite phase is sufficiently formed, and cooling may be ended in a temperature range of preferably 400 to 600° C.

Normalizing Heat Treatment

After the cooling the hot-rolled steel sheet is completed as described above, normalizing heat treatment for heating the hot-rolled steel sheet to 860 to 930° C., maintaining the hot-rolled steel sheet for 15 to 60 minutes, and then air-cooling the hot-rolled steel sheet to room temperature may be performed.

The heat treatment may be performed at 860° C. or higher in order to sufficiently homogenize an austenite structure through the normalizing heat treatment described above. However, in order to prevent coarsening of fine precipitates such as NbC and VC, an upper limit of the heat treatment temperature is limited to 930° C.

In addition, the heat treatment may be performed for 15 minutes or longer for homogenization of the austenite structure and sufficient diffusion of a solute. However, the heat treatment time may be limited to 60 minutes or less in consideration of a risk that precipitates will become coarse at the time of performing the heat treatment for a long period of time.

The hot-rolled steel sheet immediately after completion of the normalizing heat treatment described above may have ferrite having an average crystal grain size of 40 μm or less, and a strength and low-temperature toughness of a final steel material may thus be effectively secured.

Hereinafter, the present disclosure will be described in more detail through example. However, it is to be noted that the following example is for describing the present disclosure by way of illustration and is not intended to limit the scope of the present disclosure. The reason is that the scope of the present disclosure is determined by contents described in the claims and contents reasonably inferred from these contents.

MODE FOR INVENTION

Example

Respective steel slab having alloy compositions shown in Table 1 below were reheated at 1170° C. and then finished hot rolled at 950° C. to manufacture hot-rolled steel sheets. In this case, reduction ratios per pass at the time of finish hot rolling were shown in Table 2 below. Then, cooling was performed to 530° C. at respective cooling rates shown in Table 2 below, and normalizing heat treatment was then performed under conditions shown in Table 2 to prepare hot-rolled steel sheets.

For respective hot-rolled steel sheets, average void sizes, length ratios (short side/long side) of voids, pearlite fractions, tensile strengths, Charpy impact absorption energies at −50° C., hydrogen induced cracking crack length ratios (HIC CLR) were measured, and measurement results were shown in Table 3.

In this case, the hydrogen induced cracking crack length ratio (CLR) (%) in a length direction of a plate used as an index of hydrogen induced cracking (HIC) resistance of the steel sheet was calculated and evaluated as a value obtained by immersing a specimen in a 5% NaCl+0.5% $CH_3COOH$ solution saturated with one atmospheric pressure of $H_2S$ gas for 96 hours according to NACE TM0284, which is a relevant international standard, measuring lengths of cracks by ultrasonic flaw detection, and dividing a total length of respective crack in a length direction of the specimen by a total length of the specimen.

In addition, a microstructure fraction in a steel was quantitatively measured using an image analyzer after an image is measured at a magnification of 200 using an optical microscope.

A tensile test was evaluated at room temperature, and impact toughness was measured as an average value of values obtained by conducting a Charpy V-Notch impact test three times at −50° C.

TABLE 1

| Steel | Alloy Composition (wt %) | | | | | | | | | | | | | |
|---|---|---|---|---|---|---|---|---|---|---|---|---|---|---|
| Type | C | Si | Mn | Al | P* | S* | Nb | V | Ti | Cr | Mo | Cu | Ni | Ca* |
| Steel 1 | 0.18 | 0.35 | 1.15 | 0.035 | 30 | 8 | 0.007 | 0.001 | 0.001 | 0.03 | 0.05 | 0.05 | 0.10 | 35 |
| Steel 2 | 0.16 | 0.31 | 1.23 | 0.031 | 70 | 6 | 0.010 | 0.003 | 0.011 | 0.01 | 0.07 | 0.01 | 0.20 | 33 |
| Steel 3 | 0.14 | 0.33 | 1.10 | 0.030 | 81 | 7 | 0.008 | 0.005 | 0.008 | 0.05 | 0.04 | 0.08 | 0.15 | 37 |
| Steel 4 | 0.08 | 0.35 | 1.15 | 0.030 | 80 | 10 | 0.012 | 0.010 | 0.011 | 0.05 | 0.07 | 0.05 | 0.12 | 36 |

(In Table 1, contents of P*, S*, and Ca* are represented by ppm.)

TABLE 2

| | | | Normalizing Heat Treatment | | | |
|---|---|---|---|---|---|---|
| Steel Type | Reduction Ratio (%) per Pass | Cooling Rate (° C./s) | Temperature (° C.) | Time (Minute) | Thickness (mm) | Division |
| Steel 1 | 5 | 33 | 893 | 39 | 60 | Inventive Example 1 |
| Steel 2 | 4 | 27 | 890 | 31 | 60 | Inventive Example 2 |
| Steel 3 | 3 | 19 | 910 | 27 | 100 | Inventive Example 3 |
| Steel 2 | 10 | 35 | 907 | 28 | 100 | Comparative Example 1 |
| Steel 2 | 5 | 88 | 905 | 20 | 100 | Comparative Example 2 |
| Steel 3 | 11 | 33 | 907 | 27 | 200 | Comparative Example 3 |
| Steel 3 | 3 | 75 | 910 | 31 | 200 | Comparative Example 4 |
| Steel 4 | 5 | 36 | 911 | 25 | 200 | Comparative Example 5 |

TABLE 3

| Division | Microstructure: Average Size (μm) of F Crystal Grains | Microstructure: P Fraction (Area %) | Void Shape: Length (μm) of Long Side Portion | Void Shape: Length (μm) of Short Side Portion | Void Shape: Length Ratio (Short/Long) | Physical Property: Tensile Strength (MPa) | Physical Property: Impact Toughness (J) | Physical Property: CLR (%) |
|---|---|---|---|---|---|---|---|---|
| Inventive Example 1 | 23 | 17.5 | 6.4 | 5.4 | 0.84 | 515 | 245 | 0 |
| Inventive Example 2 | 18 | 15.3 | 6.9 | 6.3 | 0.91 | 523 | 239 | 0 |
| Inventive Example 3 | 17 | 13.9 | 7.3 | 6.8 | 0.93 | 517 | 240 | 0 |
| Comparative Example 1 | 18 | 15.3 | 6.8 | 1.3 | 0.19 | 513 | 298 | 32 |
| Comparative Example 2 | 18 | 15.3 | 5.4 | 5.0 | 0.93 | 525 | 15 | 0 |
| Comparative Example 3 | 13 | 13.9 | 0.71 | 0.24 | 0.34 | 513 | 249 | 22 |
| Comparative Example 4 | 19 | 13.9 | 8.2 | 7.3 | 0.89 | 509 | 23 | 0 |
| Comparative Example 5 | 24.3 | 5.5 | 5.4 | 4.8 | 0.89 | 450 | 300 | 0 |

(In Table 3, F indicates ferrite, P indicates pearlite, and impact toughness (J) indicates a Charpy impact absorption energy value at −50° C.)

(In Table 3, the remainder except for a P fraction of each specimen is F (ferrite).)

It may be confirmed from Tables 1 to 3 that in Inventive Examples 1 to 3 satisfying both of an alloy composition and a manufacturing condition of the present disclosure, a tensile strength is 500 MPa or more, a Charpy impact absorption energy at −50° C. is 230 J or more, and HIC resistance is excellent.

On the other hand, it may be confirmed that in Comparative Examples 1 to 4, alloy compositions satisfy the present disclosure, but manufacturing conditions deviate from the present disclosure, such that impact toughness or HIC resistance is inferior. It may be confirmed that in particular, in Comparative Examples 1 and 3 in which a reduction ratio per pass at the time of finish hot rolling exceeds 5%, hydrogen induced cracking crack length ratios (CLRs) are 32% and 22%, respectively, such that hydrogen induced cracking characteristics are very inferior. It may be confirmed that in Comparative Examples 2 and 4 in which reduction ratios per pass at the time of finish hot rolling are 5% or less, but cooling rates at the time of cooling are too excessive, impact toughness is very inferior.

Meanwhile, it may be confirmed that in Comparative Example 5 in which a content of C in an alloy composition is insufficient, a tensile strength is somewhat inferior even though a manufacturing condition satisfies the present disclosure.

Therefore, according to the steel material having excellent hydrogen induced cracking resistance and the manufacturing method therefor according to an exemplary embodiment in the present disclosure, a steel material that has a thickness suitable for a pressure vessel, and effectively secures hydrogen induced cracking resistance, and a manufacturing method therefor may be provided.

While the present disclosure has been described in detail through exemplary embodiment, other types of exemplary embodiments are also possible. Therefore, the technical spirit and scope of the claims set forth below are not limited to exemplary embodiments.

The invention claimed is:

1. A steel material having excellent hydrogen induced cracking resistance, comprising:

by wt %, 0.10 to 0.25% of carbon (C), 0.05 to 0.50% of silicon (Si), 1.0 to 2.0% of manganese (Mn), 0.005 to 0.1% of aluminum (Al), 0.010% or less of phosphorus (P), 0.0015% or less of sulfur(S), 0.001 to 0.03% of niobium (Nb), 0.001 to 0.03% of vanadium (V), 0.001 to 0.03% of titanium (Ti), 0.01 to 0.20% of chromium (Cr), 0.01 to 0.15% of molybdenum (Mo), 0.01 to 0.50% of copper (Cu), 0.05 to 0.50% of nickel (Ni), 0.0005 to 0.0040% of calcium (Ca), a balance of Fe, and other inevitable impurities, wherein a length ratio of a short side portion to a long side portion (short side portion/long side portion) of a void formed at a central portion of the steel material is 0.7 or more, and wherein the steel material has a tensile strength of 515 MPa or more, and a Charpy impact absorption energy at −50° C. of 239 J or more.

2. The steel material of claim 1, wherein the steel material comprises a composite structure of ferrite having an area fraction of 70% or more and the balance pearlite.

3. The steel material of claim 2, wherein an average crystal grain size of the ferrite is 40 μm or less.

4. The steel material of claim 1, wherein the steel material has a hydrogen induced cracking crack length ratio (CLR) of 5% or less.

5. The steel material of claim 1, wherein the steel material has a thickness of 50 to 200 mm.

6. The steel material of claim 3, wherein the steel material has a hydrogen induced cracking crack length ratio (CLR) of 5% or less, wherein the steel material has a thickness of 50 to 200 mm, and wherein the steel material is manufactured (i) at a reduction ratio per pass of 5% or less, (ii) by cooling to a temperature of 400 to 600° C. at a cooling rate of 27 to 60° C./s, and (iii) by a normalizing heat treatment.

* * * * *